US010243269B2

(12) United States Patent
Gommé et al.

(10) Patent No.: US 10,243,269 B2
(45) Date of Patent: Mar. 26, 2019

(54) ANTENNA

(71) Applicant: NXP B.V., Eindhoven (NL)

(72) Inventors: Liesbeth Gommé, Anderlecht (BE); Anthony Kerselaers, Herselt (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/873,714

(22) Filed: Jan. 17, 2018

(65) Prior Publication Data

US 2018/0233811 A1 Aug. 16, 2018

(30) Foreign Application Priority Data

Feb. 15, 2017 (EP) ..... 17156294.5

(51) Int. Cl.
*H01Q 1/32* (2006.01)
*H01Q 5/40* (2015.01)
*H01Q 9/32* (2006.01)

(52) U.S. Cl.
CPC ..... *H01Q 5/40* (2015.01); *H01Q 1/3275* (2013.01); *H01Q 9/32* (2013.01)

(58) Field of Classification Search
CPC ..... H01Q 1/3216; H01Q 1/3275; H01Q 1/38; H01Q 5/35; H01Q 5/40; H01Q 5/42; H01Q 9/32; H01Q 13/106
See application file for complete search history.

(56) References Cited

U.S. PATENT DOCUMENTS 7,405,699 B2 7/2008 Qin
9,083,414 B2 7/2015 Basnayake et al.
9,570,810 B2 * 2/2017 Kerselaers ..... H01Q 13/106
2014/0292593 A1 10/2014 Thiam et al.
2014/0347231 A1 11/2014 Kerselaers et al.

FOREIGN PATENT DOCUMENTS

EP 2 8064 97 12/2015
KR 10-2016-0025646 A 3/2016
WO 2004/082072 A1 9/2004

OTHER PUBLICATIONS

Sawaya, T. "Telematics and ITS integrated vehicular antenna with CRLH-TL parasitic element", International Symposium on Antennas and Propagation (ISAP), Nagoys, pp. 1329-1332 (2012).

* cited by examiner

*Primary Examiner* — Robert Karacsony
(74) *Attorney, Agent, or Firm* — Rajeev Madnawat

(57) ABSTRACT

The disclosure relates to an antenna including a substrate and a conductor pattern on the substrate. The conductor pattern comprises first and second conductor areas and the first conductor area is generally at a first end of the substrate and the second conductor area is generally at an opposing second end of the substrate. A first direction extends between the first and second ends of the substrate. The first conductor area has two arms, the two first conductor area arms extend parallel to the first direction and define a first slot between them; wherein the second conductor area has two arms with a second slot defined between them, and the two second conductor area arms extend parallel to the first direction. The two second conductor area arms sit within the first slot with a portion of the first slot at the outer sides of the two second conductor area arms.

15 Claims, 10 Drawing Sheets

ANTENNA

CROSS-REFERENCE TO RELATED APPLICATIONS

This application claims the priority under 35 U.S.C. § 119 of European Patent application No. 17156294.5, filed on Feb. 15, 2017, the contents of which are incorporated by reference herein.

The present disclosure relates to an antenna, and in particular, although not exclusively, to an antenna for car-to-X (C2X) communication.

C2X communication is believed to be a key technology in contributing to safe and intelligent mobility in the future. A C2X communication link consists of various components of which the antenna is the subject of this disclosure.

Today's vehicles are equipped with many wireless services to receive radio and television broadcasting and to support communication devices such as cellular phones and GPS for navigation. Even more communication systems will be implemented for "intelligent driving", such as wireless access in vehicular environments (WAVE), a vehicular communication system. As a result, the number of automotive antennas is increasing and the miniaturization requirements are becoming an important factor to reduce the cost.

The car-to-car communication system in Europe and USA makes uses of the IEEE802.11p standard, which can operate in:

ITS-G5A, ITS-G5B and ITS-G5D bands at 5.855-5.925 GHz, which may be referred to as a first high frequency band.

ITS-GSC band at 5.470-5.725 GHz is dedicated to WLAN, which may be referred to as a second high frequency band.

The Japanese ARIB STD-T109 standard dedicates a band at about 700 MHz-800 MHz to Intelligent Transport Systems, which may be referred to as a low frequency band. An operating frequency of within the low frequency band is typically 755.5-764.5 MHz, with a center frequency of 760 MHz and an occupied bandwidth of 9 MHz or less. In some countries, LTE communications operate at similar frequencies, starting as low as 700 MHz.

An antenna arrangement for an automotive application may be provided within a shark fin-type structure on the roof of a vehicle. A single resonant antenna element has dimensions, which are inversely proportional to the frequency of operation. An antenna arrangement may have a first antenna element for operating at the high frequency bands and a separate second antenna element for operating at the low. In order to fit within the confines of the shark fin-type structure, the second antenna element may be provided in a taller part of the shark fin, next to the first antenna element in a shallower part of the shark fin. A difficulty with such antenna arrangements is that the first and second antenna elements typically interfere with each other and so result in an inhomogeneous radiation pattern. That is, a radiation pattern with compromised omni-directionality.

According to a first aspect of the present disclosure there is provided an antenna comprising:

a substrate;

a conductor pattern on the substrate, wherein the conductor pattern comprises first and second conductor areas, wherein the first conductor area is generally at a first end of the substrate and the second conductor area is generally at an opposing second end of the substrate, wherein a first direction extends between the first and second ends of the substrate;

wherein the first conductor area has two arms, the two first conductor area arms extend parallel to the first direction and define a first slot between them;

wherein the second conductor area has two arms with a second slot defined between them, and the two second conductor area arms extend parallel to the first direction, wherein the two second conductor area arms sit within the first slot with a portion of the first slot at the outer sides of the two second conductor area arms, wherein the second conductor area has a third arm extending parallel to the first direction but opposite to the two other second conductor arms;

a first feeding port which bridges an end of one of the two second conductor area arms and a base of the first slot; and a second feeding port which bridges an end of the other of the two second conductor area arms and the base of the first slot.

a third feeding port for the second conductor area.

The antenna effectively combines two antenna structures to obtain a compact and integrated triple-feed, dual-band diversity antenna. Combining multiple antennas in one antenna structure may reduce the physical footprint of the antenna, which is desirable for some automotive applications. Further, the radiation pattern produced by the antenna has been found to have good omni-directionality when operated in a plurality of frequency bands.

The substrate may be planar or flat. The conductor pattern may be printed on the substrate. The first conductor area may be provided by a continuous conductor. The second conductor area may be provided by a continuous conductor. The first conductor may be separate to, or separated from, the second conductor. The two arms of the first conductor area are provided on respective opposed outer sides of the conductor area.

Opposed sides of the first and second conductor areas may extend in the first direction between the first and second ends of the substrate. The two arms of the first conductor area may be provided at respective sides of the first conductor area.

The first conductor area may be generally at a first end of the substrate in that a majority of the first conductor area is nearer to the first end of the substrate than a majority of the second conductor area. The second conductor area may be generally at opposing second end of the substrate in that a majority of the second conductor area is nearer to the second end of the substrate than a majority of the first conductor area. A majority of an area may be greater than half of that area.

The first feeding port may bridge the end of one of the two second conductor area arms and the first conductor area at a base of the first slot. The second feeding port may bridge the end of the other of the two second conductor area arms and the first conductor area at the base of the first slot.

The antenna may comprise a mounting element at the second end of the substrate. The mounting element may be configured to mount the substrate on a ground plane. The antenna may comprise a ground plane attached to the second end of the substrate. The ground plane may be perpendicular to the substrate. The third feeding port may be situated between the second conductor area and the ground plane. The third feeding port may bridge the second conductor area and the ground plane. The third feeding port may be at the second end of the substrate. The third feeding port may be closer to the second end of the substrate than the second conductor area. The third feeding port may be electrically connected to the ground plane. The third feeding port may be electrically connected to the second conductor area. The third feeding port may be adjacent to the second end of the substrate.

The second conductor area may provide a virtual ground plane for the antenna. The second conductor area may provide a ground plane for the antenna for a signal fed to the first and second feeding ports.

The second conductor area may be longer in the first direction than the first conductor area.

The first and second feeding ports may support operation in a frequency band within the range 4.95-6.0 GHz. The first and second conductor areas may support operation in a frequency band within the range 4.95-6.0 GHz. The antenna may be designed for an operational frequency of 5.9 GHz. The antenna may be configured to operate at a frequency of 5.9 GHz. The third feeding port may support operation in a frequency band including 700 MHz. The first and second conductor areas may support operation in a frequency band including 700 MHz. The third feeding port may support operation in a frequency band within the range of 755-765 MHz. The first and second conductor areas may support operation in a frequency band within the range of 755-765 MHz. The antenna may be designed for an operational frequency of 760 MHz.

According to a further aspect of the disclosure there is provided a vehicle antenna comprising the antenna.

According to a further aspect of the disclosure there is provided an antenna unit comprising the vehicle antenna and an outer housing for mounting on a vehicle roof. The outer housing may comprise a vertical web in which the substrate is positioned. The outer housing may have a height of less than 100 mm. The outer housing may have a width of less than 70 mm. The outer housing may have a length of less than 200 mm.

According to a further aspect of the disclosure there is provided a vehicle or vehicle communications system comprising the antenna or the antenna unit.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

One or more embodiments will now be described by way of example only with reference to the accompanying drawings in which.

Figure 1:
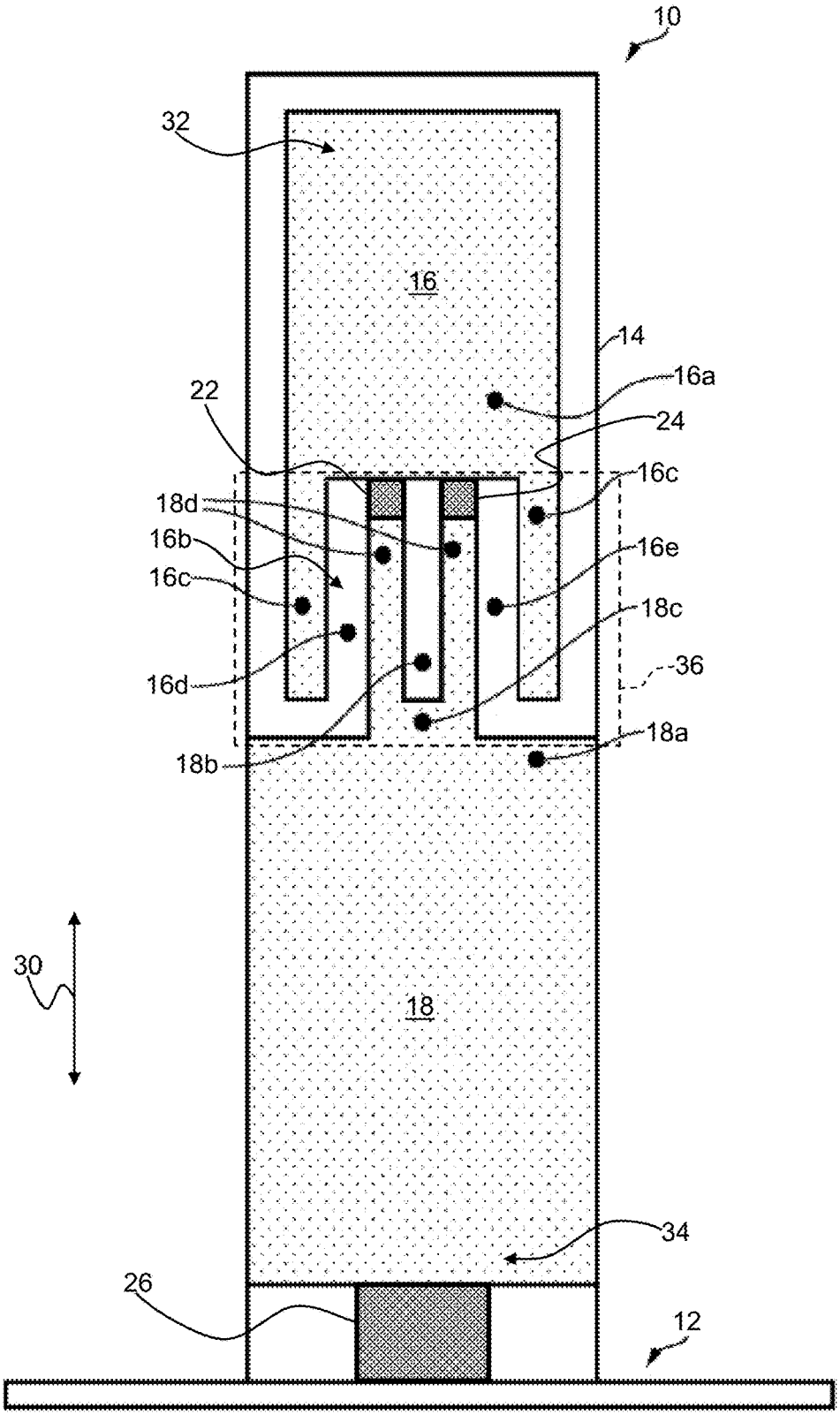
FIG. 1 shows a multi-feed multi-band diversity antenna.

FIG. 1 illustrates a schematic view of an antenna 10. The antenna provides dual-band operation that may enable MIMO functionality for car-to-X communication and RLAN in the high frequency bands, which may be at 5.470-5.925 GHz, and ITS or LTE bandwidth support in a low frequency band (relative to the high frequency bands), which may be at 700-800 MHz. In this example, the high frequency bands are provided in a first frequency band that is greater than 1 GHz away from the relatively low frequency band.

NXP TEF5100/5200 is a dual radio multi-band RF transceiver IC for Car-to-X (C2X) applications that supports four frequency bands, WAVE Japan at 760 MHz, Wi-Fi from 2.4 to 2.5 GHz, Wi-Fi from 4.9 to 5.85 GHz and WAVE 802.11p 5.85 to 5.95 GHz. The architecture supports 2×2-diversity operation in some use cases. A communication system may be provided comprising the antenna 10, such an RF transceiver, a software-defined radio processor, a secure element and an applications processor.

The antenna 10 comprises a planar substrate 14. A first conductor area 16 and second conductor area 18 are provided on a single surface of the planar substrate 14. Providing the conductor areas 16, 18 on only one side of the substrate 14 may reduce the cost of manufacturing the antenna.

The planar substrate 14 may be a printed circuit board material such as FR4 or any dielectric material that has sufficient performance for the frequency bands of operation. The choice of substrate 14 may be kept low cost and the fabrication can be kept very low cost since existing technologies for printed circuit boards can be used.

The conductor areas 16, 18 may be made of copper or another material that has sufficient performance for the frequency bands of operation. The conductor areas 16, 18 may be very thin, for example 35 μm or thinner. The conductor areas 16, 18 may be covered by a protecting layer to prevent oxidation and to reduce degradation due to temperature and as such to fulfil the stringent requirements of automotive applications.

The antenna 10 operates above a ground plane 12 such as a roof top of a vehicle. The antenna 10 may be considered to comprise the ground plane 12. The substrate 14 is mounted vertically on the ground plane 12, which extends horizontally. The substrate 14 may be removably mounted on the ground plane 12, using, for example, a clip. Alternatively, the substrate 14 may be permanently connected to the ground plane 12 using, for example, an adhesive. The ground plane 12 is therefore perpendicular to the substrate 14.

The antenna 10 and its first and second conductor areas 16, 18 each extend in a first direction 30. The first direction 30 may be considered to be a longitudinal or axial direction of the antenna 10. With regard to the first direction 30, the first conductor area 16 is provided adjacent to a first end 32 of the antenna 10 and the second conductor area 18 is provided adjacent to a second end 34 of the antenna 10. An interface edge of the first conductor area 16 faces an interface edge of the second conductor area 18 at an interface region 36. An interdigitated parallel arm and slot arrangement is formed in the interface region 36 where the interface edges of the conductor areas 16,18 face each other.

The first and second conductor areas 16, 18 each comprises a main, substantially rectangular body 16*a*, 18*a* and arms 16*c*, 18*d*. The first conductor area 16 comprises two outer arms 16*c* that extend into the interface region 36 from the main body 16*a* of the first conductor area 16. The outer arms 16*c* define a single first slot 16*b* within the first conductor area 16. The first slot 16*b* is set back into the interface edge of the first conductor area 16. A slot is defined as a non-conductive portion inside, or at least partially bounded by, a conductor area. The second conductor area 18 comprises two inner arms 18*c* that extend into the interface region 36 from the main body 18*a* of the second conductor area 18. The inner arms 18*d* of the second conductor area 18 extend into the single first slot 16*b* defined by the first conductor area 16. The inner arms 18*c* define a single second slot 18*b* within the second conductor area 18. The second slot 18*b* is set back into the interface edge of the second conductor area 18. The inner arms 18*d* of the second conductor area 18 are defined between the outer arms 16*c* of the first conductor area 16. The arms 16*c*, 18*d*, which may also be referred to as limbs or fingers, can have the same length. Each of the inner arms 18*d* is separated from a respective outer arm 16*c* by an outer non-conductive portion 16*d*, 16*e*. The slot 18*b* defined between the inner arms 18*d* of the second conductor area provides a central non-conductive portion. A total of three non-conductive portions 16*d*, 16*e*, 18*b* is therefore defined between the inner and outer arms 16*c*, 18*d*. The three non-conductive portions 16*d*, 16*e*, 18*b* may also be considered to be slots. The central non-conductive portion is a closed slot and the outer non-conductive portions 16*d*, 16*e* are open slots. The "Open" means that there is not conductive material at the end of the slot, and "closed" means that there is conductive material at the end of the slot.

A projection 18*c* from the main body 18*a* of the second conductor area is provided between the inner arms 16*c* so that each of the slots provided by the non-conductive portions 16*d*, 16*e* may have the same length.

The inner arms 18*d* of the second conductor area 18 are spaced apart from the main body 16*a* of the first conductor area 16. The outer arms 16*d* of the first conductor area 16 are spaced apart from the main body 18*a* of the second conductor area 18.

The antenna 10 comprises first, second and third feeding ports 22, 24, 26. Each feeding port 22, 24, 26 provides a connection point that enables external circuitry to be connected to the antenna 10. Each feeding port 22, 24, 26 may comprise a connector (not shown) that is configured to receive a transmission line and form an electrical connection between the connector and the transmission line. The connector may comprise a gripping element.

The first and second feeding ports are intended to operate the antenna at the first and second high frequency bands, with a total bandwidth of 5.470-5.925 GHz. The first and second feeding ports 22, 24 are connected between the main body 16*a* of the first conductor area 16 and ends of the inner arms 18*d* of the second conductor area 18. In particular, the first feeding port 22 bridges an end of one of the inner arms 18*d* of the second conductor area 18 and a base of the first slot 16*b*. Further, the second feeding port 24 bridges an end of the other inner arm 18*d* of the second conductor area 18 and the base of the first slot 16*b*. The first and second feeding ports 22, 24 enable the antenna to be operated in the high frequency bands as a diversity antenna.

The antenna structure providing the performance at the higher frequency bands is the first conductor area 16 and a portion of the main body 18*a* of the second conductor area 18 that is adjacent to the interface region 36. A diversity or MIMO (Multiple Input Multiple Output) functionality is provided by the first conductor area 16 and a portion of the main body 18*a* of the second conductor area 18 that is adjacent to the interface region 36. The remainder of the main body 18*a* of the second conductor area 18, which is further towards the second end 34 of the antenna 10, provides a virtual vertical ground plane for the higher frequency bands (but not for the antenna 10 as a whole).

The length in the first direction 30 of the first conductor area 16 (including the main area and the arms) represents the half electrical wavelength of the operational frequency of the high frequency bands, while the length of the open slots 16*d*, 16*e* is a quarter electrical wavelength of the operational frequency of the frequency band of operation.

The width (perpendicular to the first direction 30) of the first conductor area 16 is not directly related to the wavelength of operation and can be smaller than quarter of the wavelength of the frequency band of operation. The width of the first conductor area 16 does have an influence on the operational bandwidth. A larger width results in a larger bandwidth.

The length in the first direction 30 of the central slot 18*b* defines the frequency where the first and second feeding ports 22, 24 have largest isolation. The length of the central slot 18*b* is a quarter electrical wavelength of the frequency where the maximum isolation is found. This is because a quarter wavelength slot that is closed at the end presents a high input impedance at the input.

The first and second feeding ports 22, 24 that are connected between the conductor areas 16,18 generate a current around the outer non-conductive portions 16*d*, 16*e*. This current couples into the first conductor area 16, and more precisely spreads out across the length, that is half the resonant wavelength at the frequency of operation.

The width of the outer non-conductive portions 16*d*, 16*e* may be used to influence the input impedance of the first and second feeding ports 22, 24. This mechanism allows matching of the first and second feeding ports 22, 24.

It has been found that the length in the first direction 30 of the main body 18*a* of the second conductor area 18 may be extended without substantially affecting the performance of the antenna in the high frequency bands. This property has been utilised to enable the second band of operation to be provided by the same antenna 10 as the high frequency bands. In this example, the main body 18*a* of the second conductor area 18 is longer in the first direction than the main body 16*a* of the first conductor area 16.

The third feeding port 26 is provided at the second end 34 of the substrate 14 and is situated between, or bridges, the second end 34 of the substrate 14 and the ground plane. The third feeding port provides a direct electrical connection to the second conductor area 18 and also a direct electrical connection to the ground plane 12. An area of the third feeding port 26 may be larger, in this example, than an area of the first or second feeding ports 22, 24 so that the third feeding port 26 is configured to receive the low frequency band, which is a lower frequency band than the high frequency bands received by the first and second feeding ports 22, 24.

A combination of the first and second conductor areas 16, 18 is able to radiate energy at the low frequency band resulting from a signal fed to the third feeding port 26. The combination of the first and second conductor areas 16, 18 provides a resonant quarter wave monopole antenna ($L=\lambda/4$) when used above a ground plane.

Simulations have demonstrated that the three feeding ports 22, 24, 26 of the multi-feed multi-band diversity antenna 10 are sufficiently matched and isolated. As discussed below, the radiation pattern provided by the antenna 10 is relatively omni-directional for both frequency bands of operation. The omni-directional nature of the antenna is enabled by providing the first and second conductor areas 16, 18 in a vertical arrangement, when in use, with the first conductor area 16 generally above the second antenna area 18. In this respect, the performance of the antenna may be improved with respect to prior art antenna arrangements in which separate antenna elements providing the low and high frequency bands of operation are provided next to each other (side-by-side), and displaced horizontally. FIGS. 2 to 10 show simulated performance results for the antenna of FIG. 1. These simulations were performed using the 3-dimensional electromagnetic simulator HFSS from the Ansys Electromagnetics Suite software.

Figure 2:
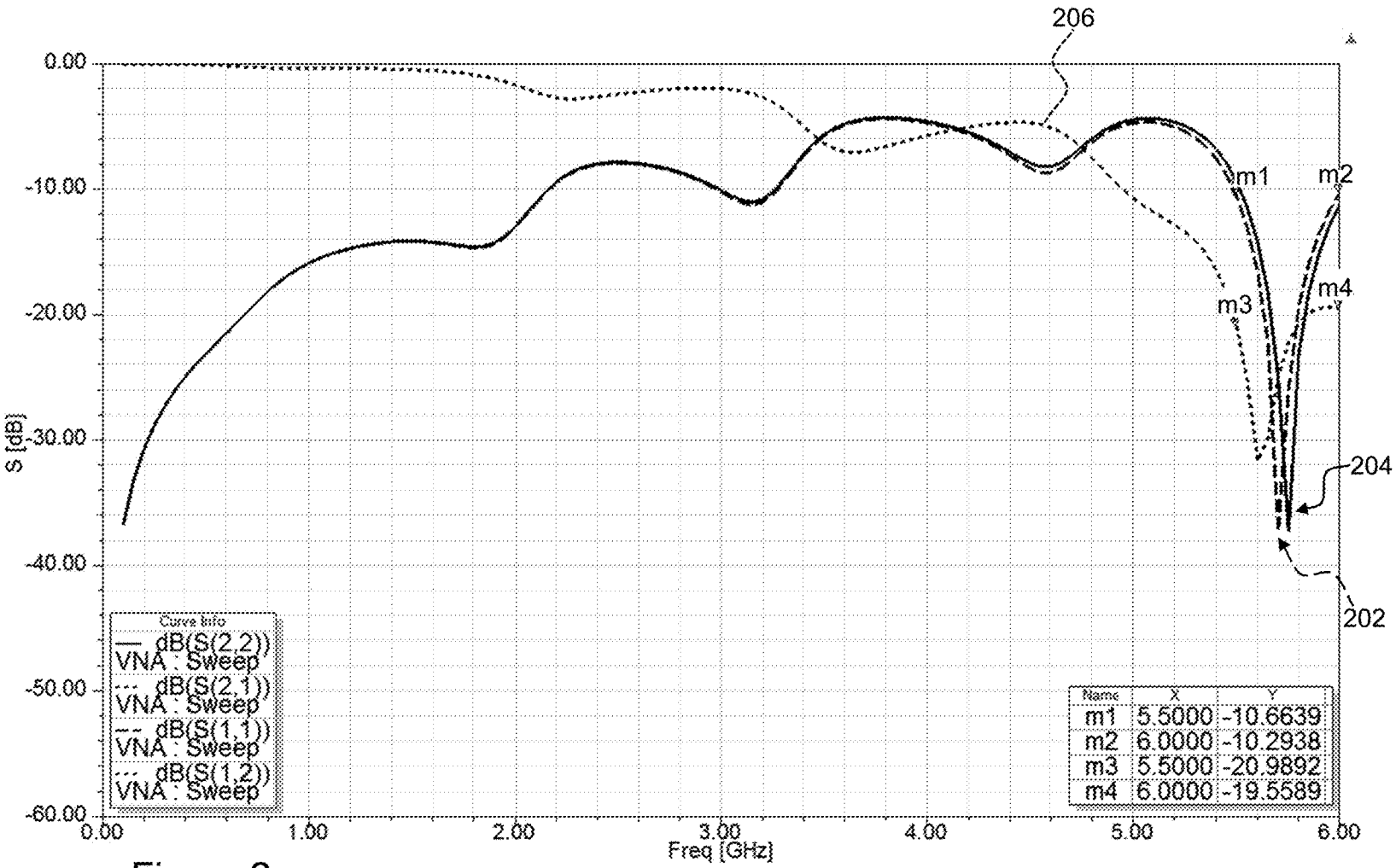
FIG. 2 shows a simulated S-parameters graph concerning first and second feeding ports in [dB] of the antenna in FIG. 1.

FIG. 2 shows, as a function of frequency, the simulated reflection coefficient (S-parameters) concerning the first and second feeding ports, in Decibels (dB), of the antenna in FIG. 1.

A first reflection coefficient profile 202 shows the input reflection coefficient of the first feeding port ($|S_{11}|$). A second reflection coefficient profile 204 shows the input reflection coefficient of the second feeding port ($|S_{22}|$). There is good matching of both the first and second feeding ports in the high frequency bands because $|S_{11}|$ or $|S_{22}|$ are below −10 dB in the high frequency bands. Markers m1, m2 on first profile 202 indicate that the matching is −10.29 dB or lower in the range 5.5-6 GHz (in the second high frequency band).

An isolation profile 206 shows the isolation between the first and second feeding ports ($|S_{21}|$ and $|S_{12}|$). Sufficient isolation between the first and second feeding ports is provided in the frequency range because $|S_{21}|$ and $|S_{21}|$ are below −9.5 dB. Markers m3, m4 on the isolation profile 206 indicate that the isolation is −19.56 dB or lower in the range 5.5-6 GHz (in the second high frequency band).

Figure 3:
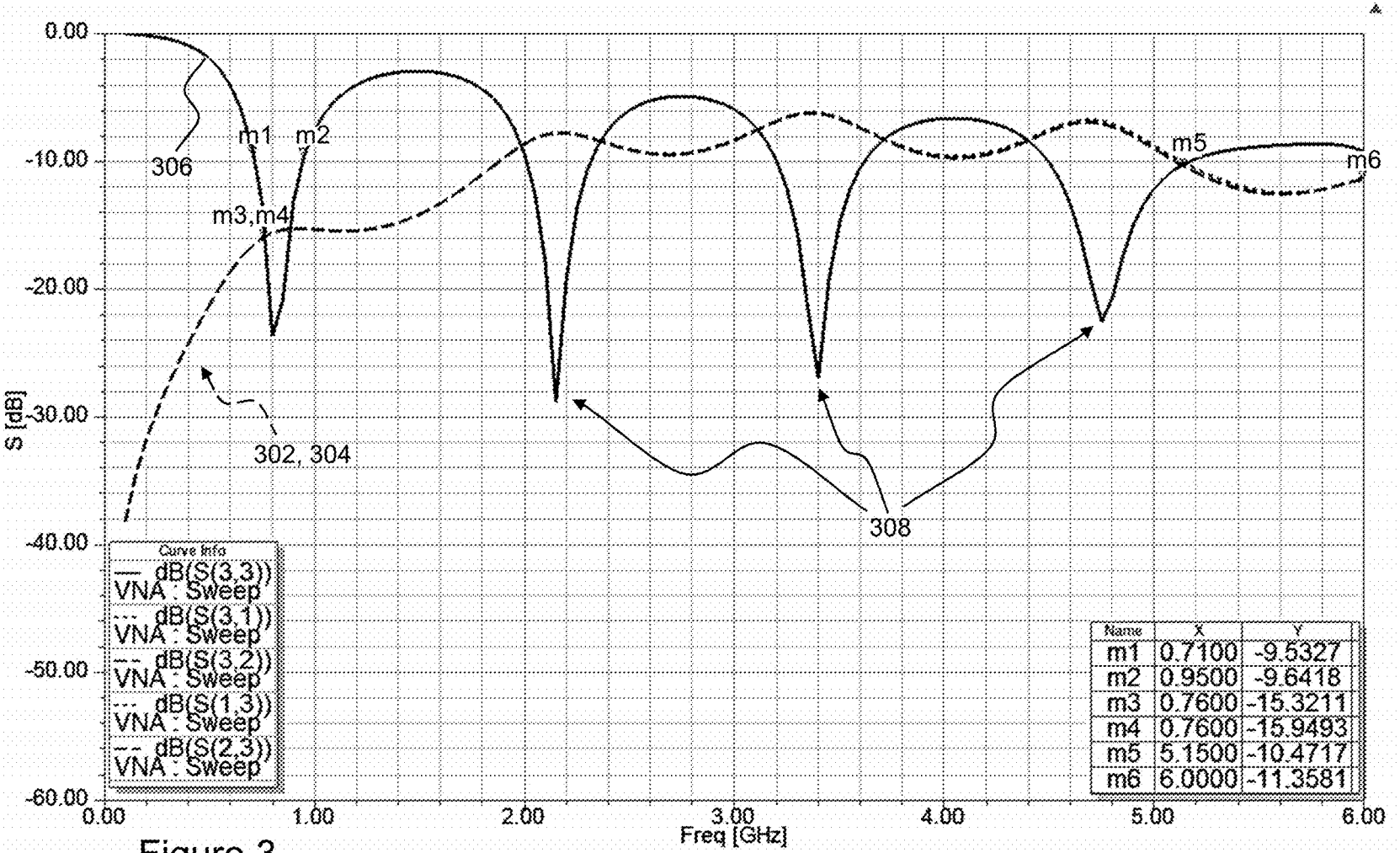
FIG. 3 shows an additional simulated S-parameters graph concerning first, second and third feeding ports in [dB] of the antenna in FIG. 1.

FIG. 3 shows additional simulated reflection coefficients (S-parameters) concerning the first, second and third feeding ports, in Decibels (dB), of the antenna in FIG. 1.

Overlapping first and second isolation profiles 302, 304 show, respectively, the isolation between the second and third feeding ports ($|S_{32}|$ and $|S_{23}|$) and the isolation between the first and third feeding ports ($|S_{31}|$ and $|S_{13}|$). There is sufficient isolation between the third feeding port and both of the first and second feeding ports in the high [5.470-5.925 GHz] and low [755-765 MHz] frequency bands because within these bands:

$|S_{32}|$ or $|S_{23}|$ are below −10 dB; and $|S_{31}|$ or $|S_{13}|$ are below −10 dB.

A third reflection coefficient profile 306 shows the input reflection coefficient of the third feeding port ($|S_{33}|$). There is a good matching of the third feeding port in the low frequency band [755-765 MHz] because $|S_{33}|$ is below −9.5 dB for a bandwidth of about 240 MHz centred on the low frequency band. The multiple minima 308 in the third reflection coefficient profile 306 relate to roughly harmonics of the central frequency of the low frequency band, and are not of particular interest.

Figure 4:
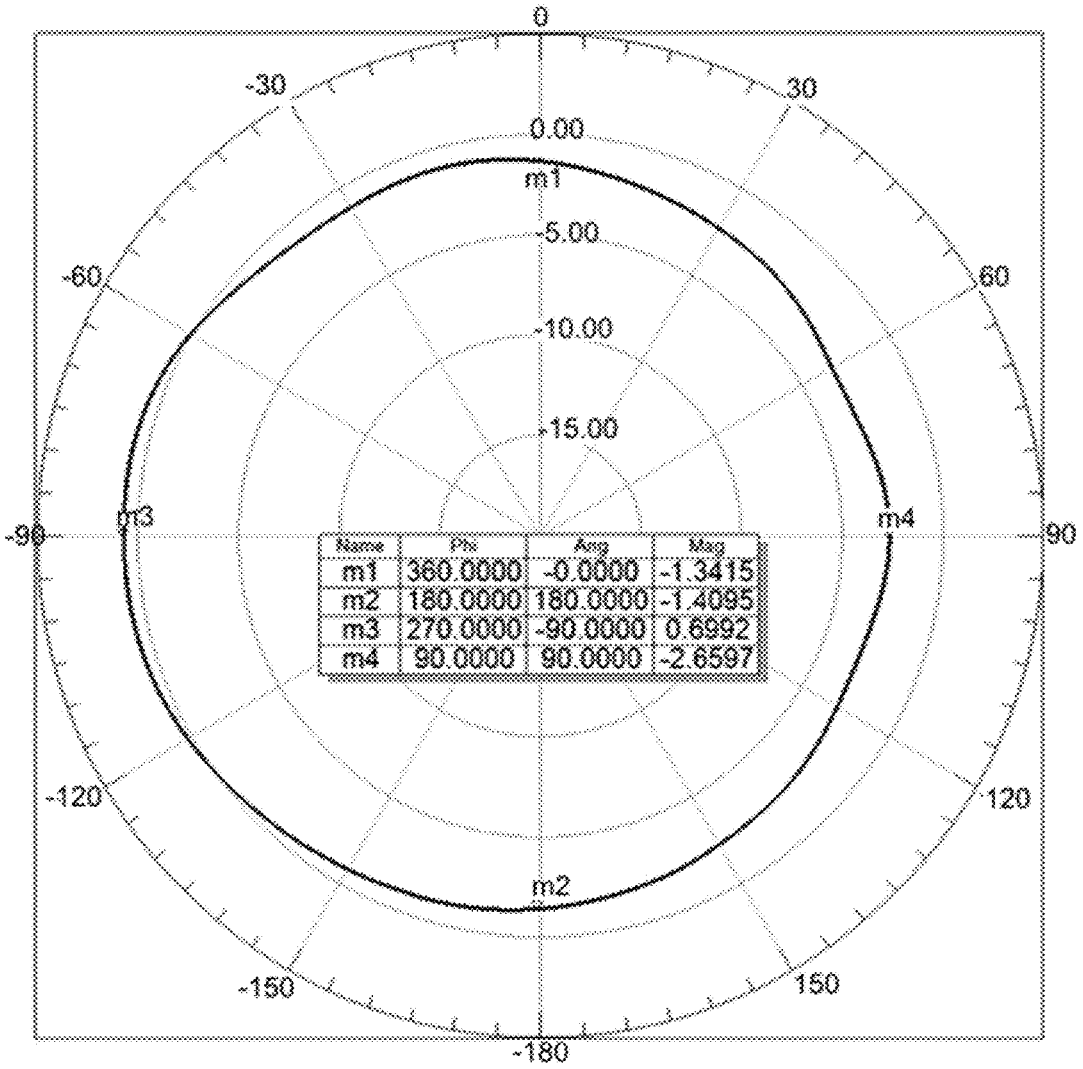
FIG. 4 shows a simulated radiation pattern in the horizontal plane [dBi] of the antenna in FIG. 1 at 5.9 GHz, with first feeding port powered.
Figure 5:
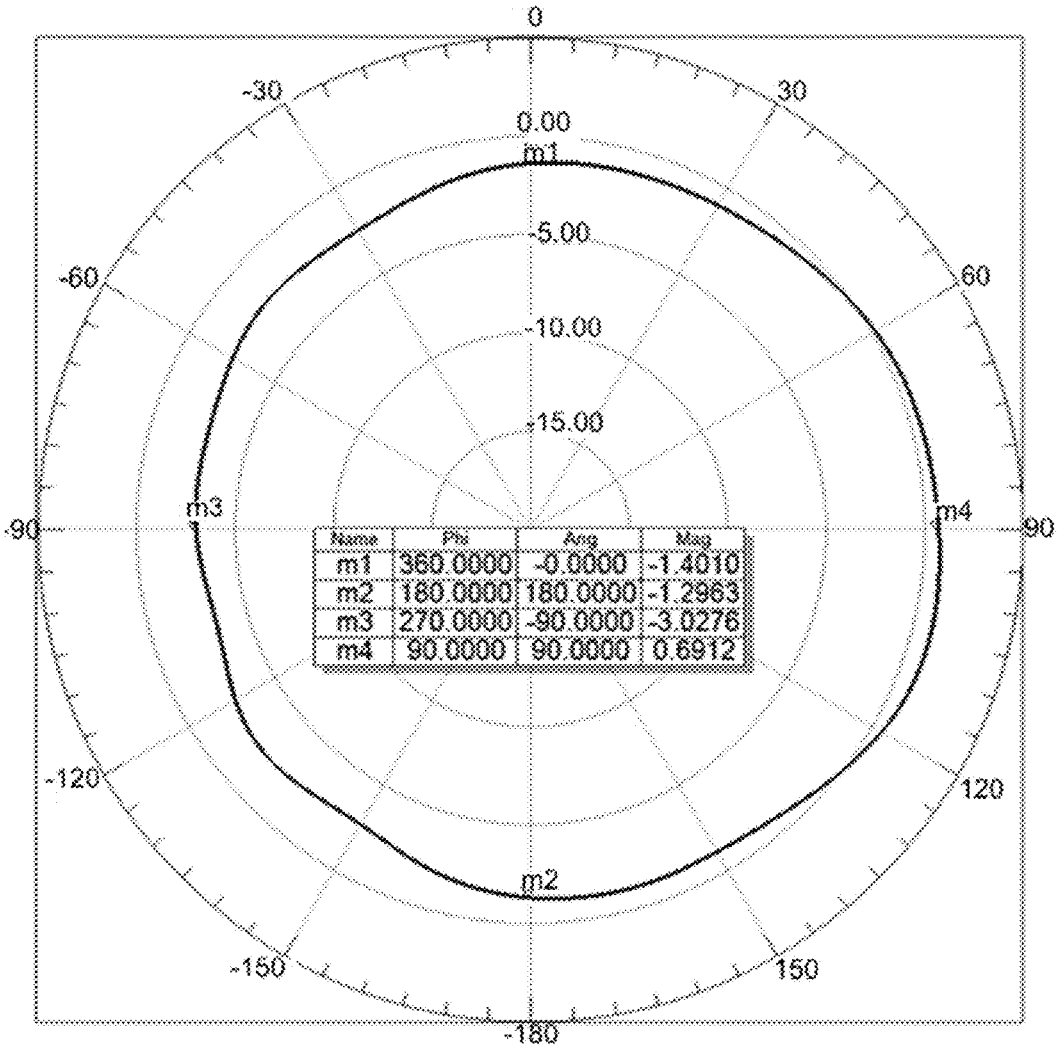
FIG. 5 shows a simulated radiation pattern in the horizontal plane [dBi] of the antenna in FIG. 1 at 5.9 GHz, with second feeding port powered.
Figure 6:
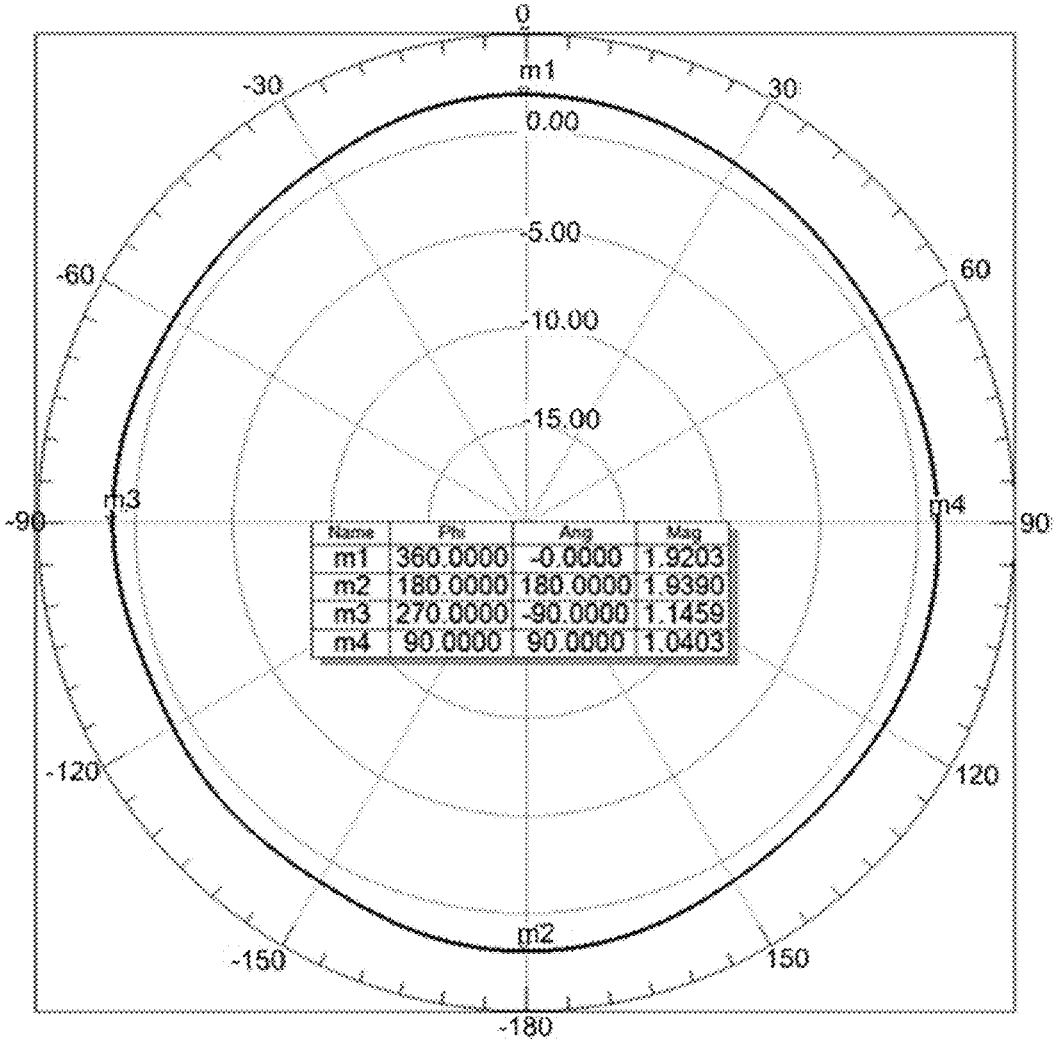
FIG. 6 shows a simulated radiation pattern in the horizontal plane [dBi] of the antenna in FIG. 1 at 5.9 GHz, with the first and second feeding ports powered.

FIGS. 4 to 6 display simulated radiation patterns [dBi] of proposed antenna of FIG. 1 in the horizontal plane at 5.9 GHz within the first high frequency band. In FIG. 4, the first feeding port is powered. In FIG. 5, the second feeding port is powered. In FIG. 6, both the first and second feeding ports are powered.

The directivity of the radiation depends on which port is fed. The gains at $\phi=270°$ and $\phi=90°$ are both 0.7 dBi for respectively marker m3 in FIG. 4 and marker m4 in FIG. 5, if one of the first and second feeding ports is driven.

In case of transmit diversity, both the first and second feeding ports are fed with the same RF signal and an omni-directional radiation pattern is established as shown in FIG. 6 with an average gain of 1.2 dBi.

Figure 7:
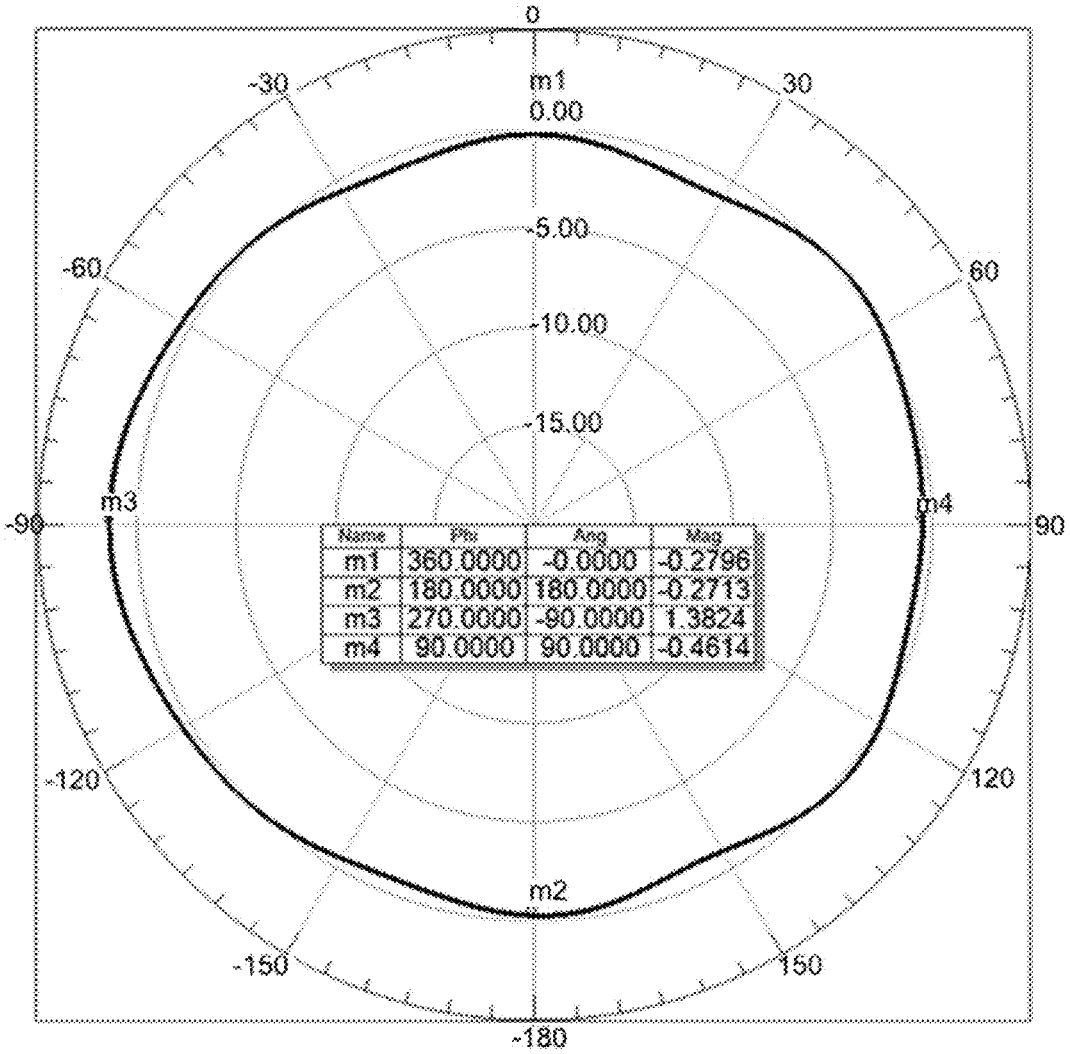
FIG. 7 shows a simulated radiation pattern in the horizontal plane [dBi] of the antenna in FIG. 1 at 5.5 GHz, with first feeding port powered.
Figure 8:
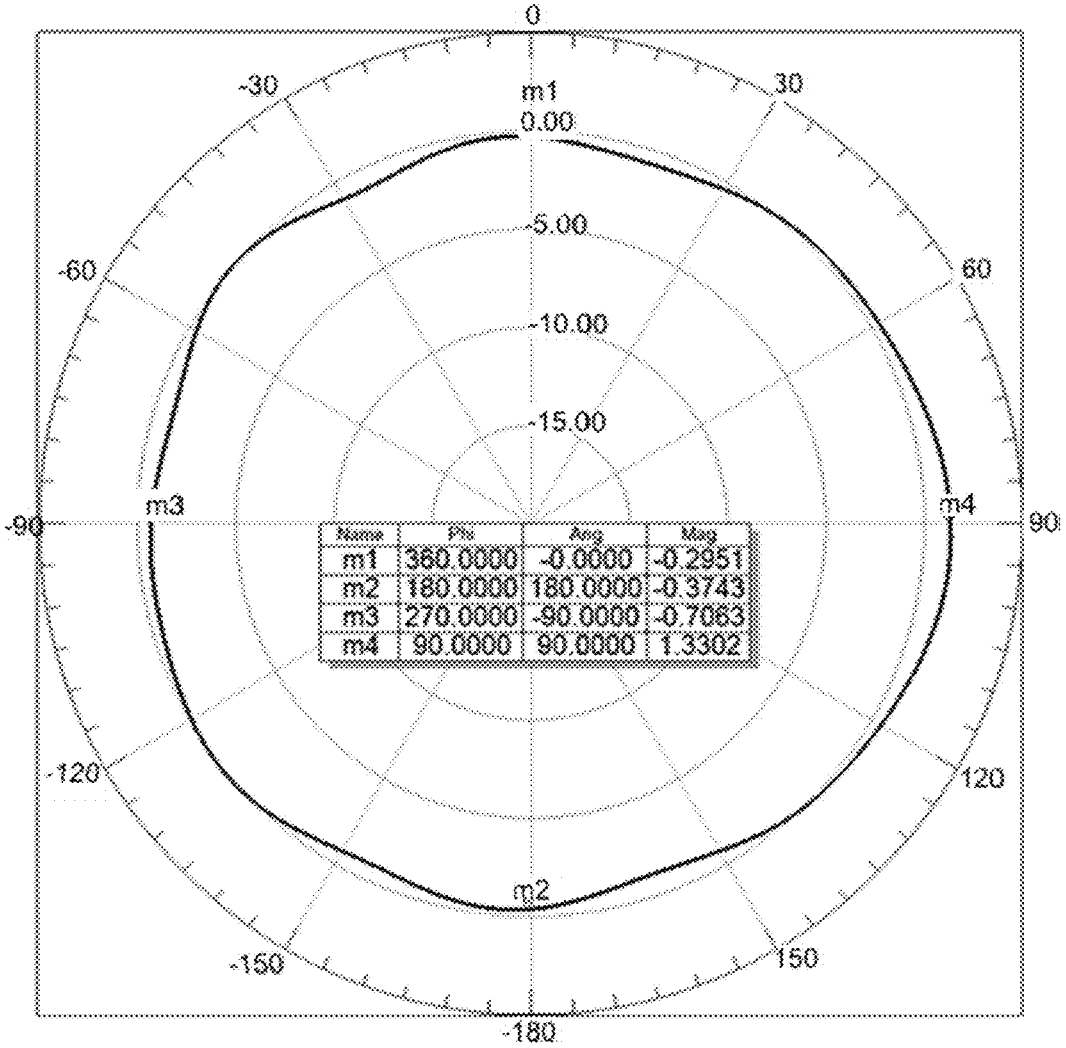
FIG. 8 shows a simulated radiation pattern in the horizontal plane [dBi] of the antenna in FIG. 1 at 5.5 GHz, with second feeding port powered.
Figure 9:
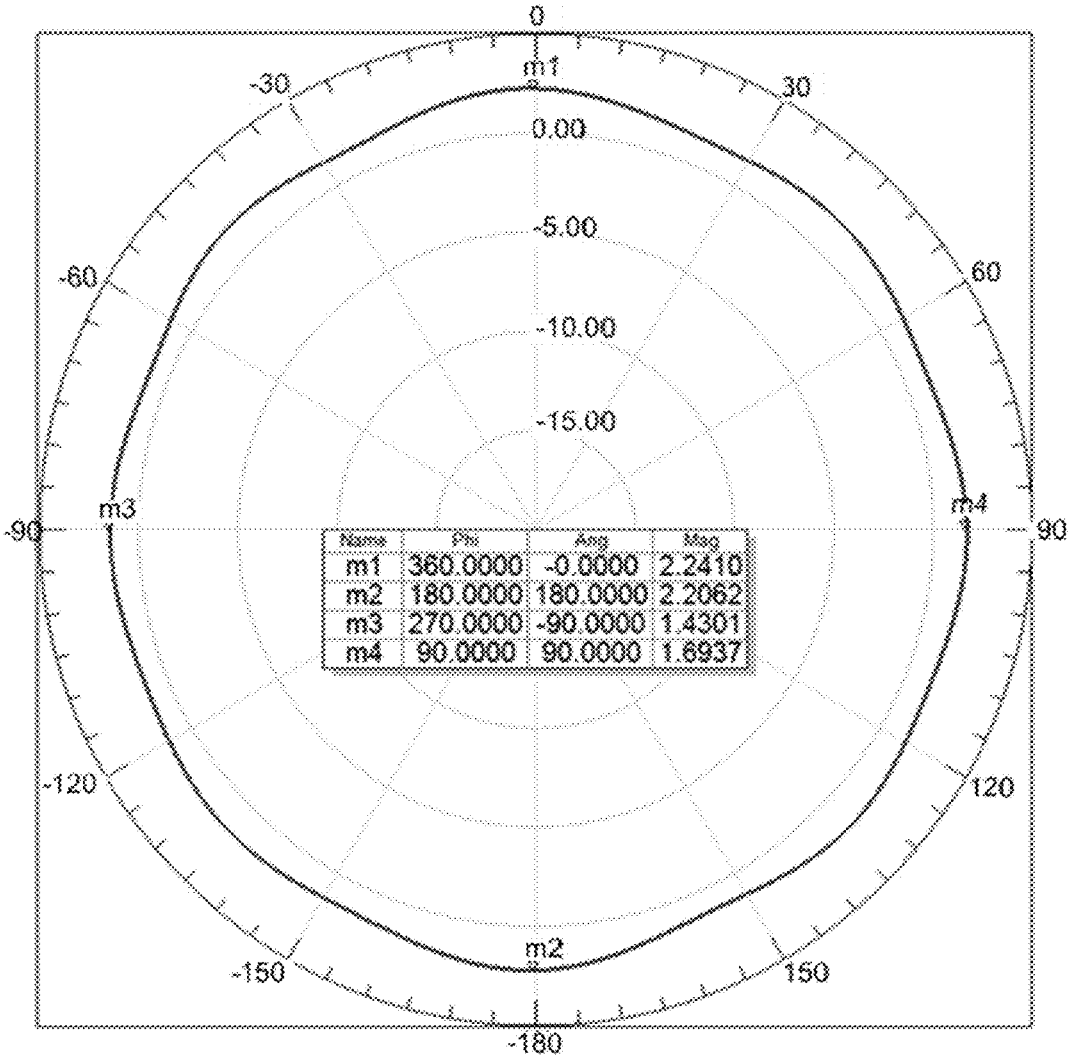
FIG. 9 shows a simulated radiation pattern in the horizontal plane [dBi] of the antenna in FIG. 1 at 5.5 GHz, with the first and second feeding ports powered.

FIGS. 7 to 9 display simulated radiation patterns [dBi] of proposed antenna of FIG. 1 in a horizontal plane at 5.5 GHz within the second high frequency band. In FIG. 7, only the first feeding port is powered. In FIG. 8, only the second feeding port is powered. In FIG. 9, both the first and second feeding ports are powered.

The directivity of the radiation depends on which feeding port is fed. The gains at $\phi=270°$ and $\phi=90°$ are both approximately 1.3 dBi for respectively marker m3 in FIG. 7 and marker m4 in FIG. 8, if one of the first and second feeding ports is driven.

In case of transmit diversity, both the first and second feeding ports are fed with the same RF signal as shown in FIG. 9. An omni-directional radiation pattern is established with an average gain of 1.5 dBi.

It has been found that the radiation directionality performance of the antenna operating the high frequency bands is relatively insensitive to the length of the second conductor area. In this way, the length of the second conductor area may be selected in order to optimise performance in the low band while maintaining acceptable performance in the high frequency bands.

Figure 10:
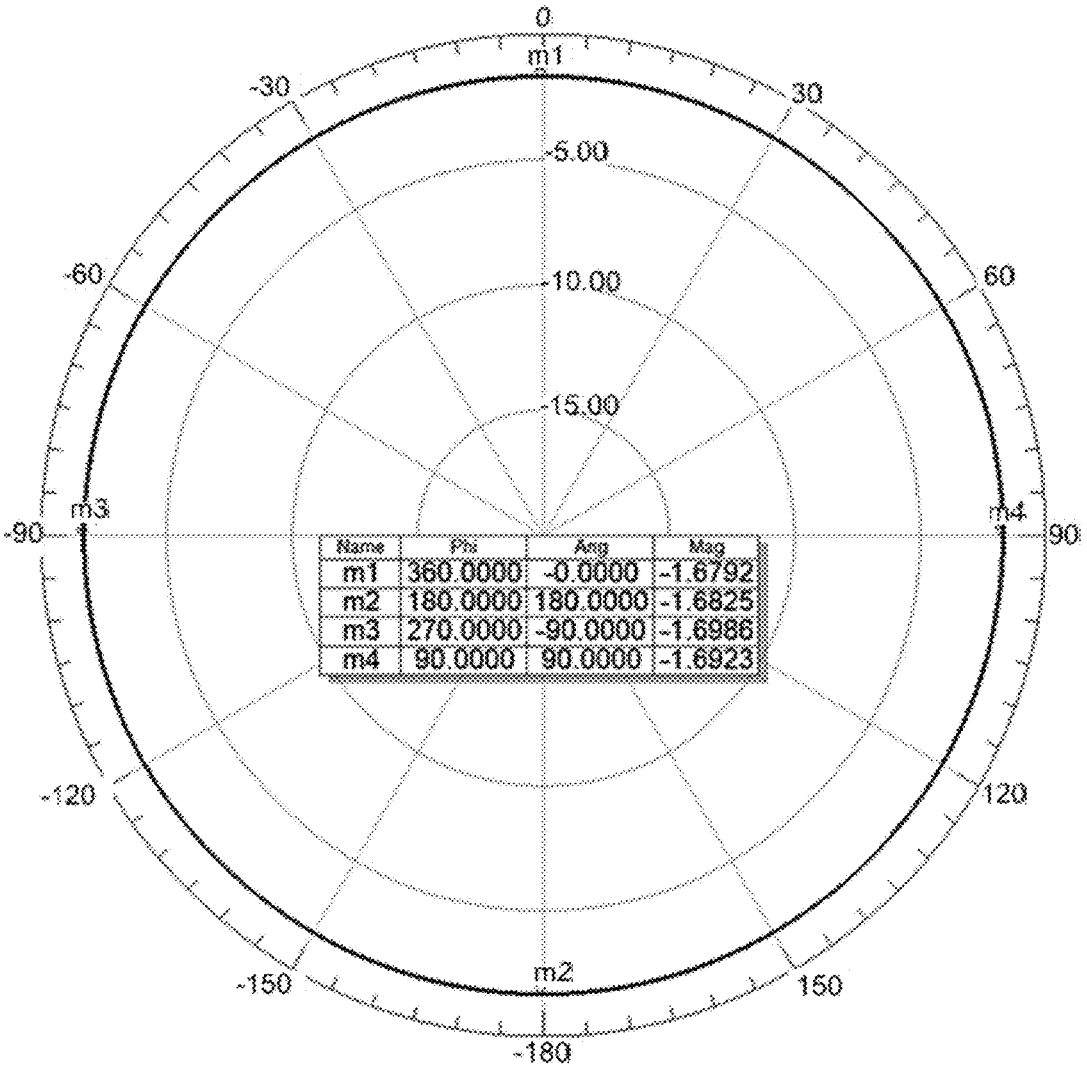
FIG. 10 shows a simulated radiation pattern in the horizontal plane [dBi] of the antenna in FIG. 1 at 760 MHz, with the third feeding port powered.

FIG. 10 shows a simulated radiation pattern in the horizontal plane [dBi] of the antenna in FIG. 1 at 760 MHz within the low frequency band, with the third feeding port powered. An omni-directional radiation pattern is established with an average gain of −1.7 dBi at 760 MHz.

Those skilled in the art will recognize that while example instructions/methods have been discussed, the material in this specification can be combined in a variety of ways to yield other examples as well, and are to be understood within a context provided by this detailed description.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. An antenna comprising:

a substrate; and a conductor pattern on the substrate, wherein the conductor pattern comprises first and second conductor areas, wherein the first conductor area is generally at a first end of the substrate and the second conductor area is generally at an opposing second end of the substrate, wherein a first direction extends between the first and second ends of the substrate;

wherein the first conductor area has two arms, the two first conductor area arms extend parallel to the first direction and define a first slot between them;

wherein the second conductor area has two arms with a second slot defined between them, and the two second conductor area arms extend parallel to the first direction, wherein the two second conductor area arms sit within the first slot with a portion of the first slot at the outer sides of the two second conductor area arms, wherein the second conductor area has a third arm extending parallel to the first direction but opposite to the two other second conductor arms;

a first feeding port which bridges an end of one of the two second conductor area arms and a base of the first slot;

a second feeding port which bridges an end of the other of the two second conductor area arms and the base of the first slot; and a third feeding port for the second conductor area.

2. The antenna of claim 1, wherein the third feeding port is adjacent to the second end of the substrate.

3. The antenna of claim 1, comprising a mounting element at the second end of the substrate, wherein the mounting element is configured to mount the substrate on a ground plane.

4. The antenna of claim 1, comprising a ground plane attached to the second end of the substrate.

5. The antenna of claim 3, wherein the ground plane is perpendicular to the substrate.

6. The antenna of claim 3, wherein the third feeding port is situated between the second conductor area and the ground plane.

7. The antenna of claim 1, wherein the second conductor area is longer in the first direction than the first conductor area.

8. The antenna of claim 1, of which the first and second feeding ports support operation in a frequency band within the range 4.95-6.0 GHz.

9. The antenna of claim 8, designed for an operational frequency of 5.9 GHz.

10. The antenna of claim 8, wherein the second conductor area provides a virtual ground plane for the antenna.

11. The antenna of claim 1, in which the third feeding port supports operation in a frequency band including 700 MHz.

12. The antenna of claim 1, in which the third feeding port supports operation in a frequency band within the range of 755-765 MHz.

13. A vehicle antenna comprising the antenna of claim 1.

14. An antenna unit comprising the vehicle antenna of claim 9, and an outer housing for mounting on a vehicle roof, the outer housing comprising a vertical web in which the substrate is positioned, wherein the outer housing has a height of less than 100 mm, a width of less than 70 mm and a length of less than 200 mm.

15. A vehicle or vehicle communications system, comprising the antenna of claim 9 or the antenna unit of claim 10.

* * * * *